United States Patent [19]

Draper

[11] 4,449,377

[45] May 22, 1984

[54] THERMOSYPHON COIL ARRANGEMENT FOR HEAT PUMP OUTDOOR UNIT

[75] Inventor: Robert Draper, Churchill, Pa.

[73] Assignee: Westinghouse Electric Corp., Pittsburgh, Pa.

[21] Appl. No.: 474,934

[22] Filed: Mar. 14, 1983

[51] Int. Cl.[3] ..... F25B 13/00

[52] U.S. Cl. ..... 62/324.1; 62/160; 62/324.6; 62/238.7

[58] Field of Search ..... 62/160, 238.7, 324.1, 62/324.6; 165/110

[56] References Cited

U.S. PATENT DOCUMENTS

| | | | |
|---|---|---|---|
| 2,096,285 | 10/1937 | Lord et al. . | |
| 2,374,184 | 4/1945 | Erland Af Kleen . | |
| 2,401,918 | 6/1946 | Elder et al. . | |
| 2,706,105 | 4/1955 | Young . | |
| 3,052,102 | 9/1962 | McMillon | 62/81 |
| 3,844,344 | 10/1974 | Kliemann et al. | 165/110 |
| 3,942,588 | 3/1976 | Schoonman | 165/110 |
| 4,098,092 | 7/1978 | Singh | 62/238.6 |
| 4,262,493 | 4/1981 | Lackey et al. | 62/324.6 |

*Primary Examiner*—Lloyd L. King
*Attorney, Agent, or Firm*—E. C. Arenz

[57] ABSTRACT

For a heat pump, the outdoor unit is provided with a coil and a refrigerant flow arrangement therefor which is such that in the heating mode of operation of the heat pump they operate in a thermosyphon fashion. The coil 32 has a feed portion 30 and an exit portion 34 leading to a separator drum 36 from which liquid refrigerant is returned through downcomer line 42 for recirculation to the feed portion. The coil is tilted upwardly from entry to exit by the angle alpha to enhance the clearance of the two phases of refrigerant from each other in the heating mode of operation. There is no thermosyphon function in the cooling mode of operation.

6 Claims, 9 Drawing Figures

THERMOSYPHON COIL ARRANGEMENT FOR HEAT PUMP OUTDOOR UNIT

GOVERNMENT CONTRACT

The Government has rights in this invention pursuant to Prime Contract No. W-7405-ENG-26 and Subcontract No. 86X-24712-C awarded by the U.S. Department of Energy.

BACKGROUND OF THE INVENTION

This invention pertains to the art of heat pumps, and in particular to a refrigerant coil and refrigerant flow arrangement for an outdoor unit of an air-to-air heat pump.

The growing desire to conserve oil and gas has enlarged the geographic region targeted for the application of electric heat pumps to include more northerly areas. Colder air temperature requires that a northern climate heat pump should have higher efficiency than that which is available with any unit which is currently manufactured, so far as I know. This is necessary if the total cost of ownership over the first several years of operation is to be comparable with that for a gas furnace.

As is well known, when a heat pump is in the heating mode, the outdoor heat exchanger or coil removes heat from the outside air through evaporating the refrigerant passing through the coil. As is also known in this art, from a thermodynamic standpoint it is desirable to exchange heat using the smallest practicable temperature difference between the air and the refrigerant. It is also desirable that this temperature difference be as near constant as possible throughout the entire heat exchanger. When these requirements are met to the fullest extent allowed by the various design constraints, the refrigerant vapor leaves the evaporator with the highest possible temperature for a given air temperature so that the temperature lift sustained by the heat pump is minimized. Consequently, this promotes a closer approach between the system COP (coefficient of performance) and the Carnot COP. If a relatively constant refrigerant temperature throughout the coil functioning as an evaporator is to be approached, minimizing the pressure drop of the refrigerant passing through the coil is vital. The refrigerant pressure drop is increasingly punitive as outdoor temperatures are lowered because of the increasing rate of change of temperature with respect to pressure with the lowered temperatures, as is readily apparent from the saturated vapor line of the pressure-enthalpy diagram for a given refrigerant.

It is known that natural thermosyphon heat exchangers as used in some processes have an inherently low pressure drop. However, so far as I know, the concept of providing a coil with a refrigerant flow arrangement therefor which is operable in a thermosyphon manner has never been applied to an outdoor unit of a heat pump.

It is the aim of this invention to provide a particular coil disposition and refrigerant flow arrangement for an outdoor unit so that the coil operates in an optimal thermosyphon fashion in the heating mode of the heat pump.

SUMMARY OF THE INVENTION

In accordance with the invention, the outdoor unit refrigerant coil and refrigerant flow arrangement include an extended surface coil of fins on single pass tubes having a slight upward inclination from one portion serving as the inlet of the coil to another portion serving as the outlet of the coil, in the heating mode of the heat pump, with the refrigerant flow arrangement for the coil operating in a thermosyphon fashion in the heating mode of the pump. The arrangement includes means for feeding said one portion of the coil refrigerant, and means receiving refrigerant, which has passed through the coil, from said another portion of the coil, with the receiving means being at an elevated height relative to the level of the centroid of the coil, and with downcomer means connecting the receiving means to the feeding means to recirculate liquid refrigerant back to the coil in the heating mode of operation of the heat pump.

In the cooling mode of operation of the heat pump, the refrigerant flow arrangement is such that there is no thermosyphon function.

DESCRIPTION OF THE PREFERRED EMBODIMENTS

Figure 1:
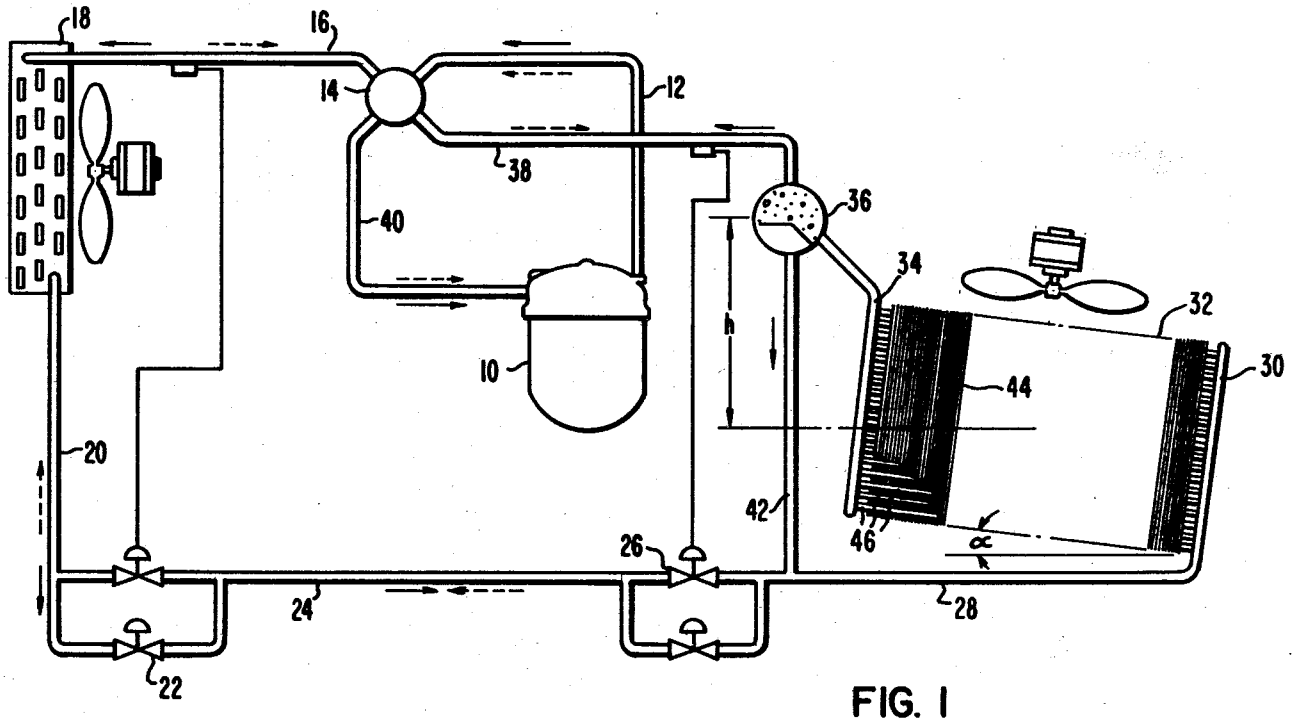
FIG. 1 is a schematic view of a heat pump with the outdoor unit refrigerant coil and refrigerant flow arrangement therefor of the invention applied to the heat pump.

The FIG. 1 illustration is provided for explaining the way in which the inventive arrangement is incorporated in an electric heat pump. The basic parts of the heat pump shown include the refrigerant compressor 10 from which hot gas is pumped through line 12 to a reversing valve 14. If the reversing valve is set for a heating operation, the hot gas passes through line 16 to the indoor coil 18 which functions as a refrigerant condenser. Liquefied refrigerant passes from the coil through line 20 and check valve 22 and line 24 to the heating cycle expansion valve 26. Two-phase refrigerant passes through line 28 to the entry portion or feed header 30 of the outdoor coil 32 and is evaporated as it passes therethrough to the exit portion or collector header 34 which is connected to a refrigerant separator drum 36. The evaporated refrigerant leaves the drum 36 from the top and passes through line 38, the reversing valve 14, and suction line 40 back to compressor 10. The liquid refrigerant separated in the drum descends through the downcomer line 42 to join the refrigerant exiting from the expansion valve 26, and is recirculated through the coil 32 along with that refrigerant. The direction of refrigerant flow in the heating mode is indicated by the solid line arrows of the system, while the direction of flow in the cooling mode is indicated by dash line arrows.

The head differential between the liquid column in the downcomer line 42 (FIG. 1) and the two-phase mixture in the tubes of the coil 32 provides the potential to drive the recirculating flow. The dimension h shown in FIG. 1 is the vertical differential between the centroid of enthalpy addition of the coil, and the centroid of enthalpy rejection. In general, the dimension h should be maximized to the extent practical to maximize the recirculation rate of the liquid refrigerant.

The coil 32 is an extended surface-type coil in which a multitude of fins 42 are provided on a number of tubes 46 through which the refrigerant flows. It is important to note that the coil 32 is slightly inclined from the horizontal so that the tubes 46 are accordingly inclined from their ends at the entry portion 30 to their ends at the exit portion 34. The angle of inclination is indicated by $\alpha$. This angle should fall in the range from about $2\frac{1}{2}$ to 10°, and in the currently preferred embodiment is in the lower portion of this range. This inclination enhances the clearance of the two refrigerant phases from each other in the heating mode.

In stable operation in a heating mode, the downcomer 42 will be substantially filled with liquid refrigerant so that the refrigerant flow arrangement for the coil operates in a thermosyphon fashion with continuing recirculation. In the cooling mode of operation, the hot gas is passed to the outside coil 32 and liquefied so that a column of liquid will stand in the downcomer 42, and there is no thermosyphon function.

The difference in pressure drop between a coil and flow arrangement according to the invention and a forced convection coil with a conventional flow arrangement giving the same basic refrigerating capacity is in the region of 1 psi (6895Pa) for my arrangement compared with about 5 psi (34475Pa) for an optimally designed forced convection coil.

Figure 2A:
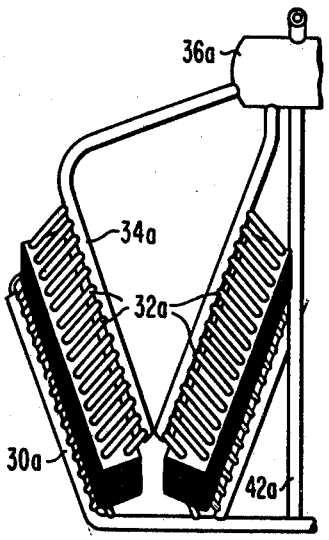
FIG. 2A is an end view of half of a coil configuration and flow arrangement particularly adapted for a particular northern climate heat pump.
Figure 3:
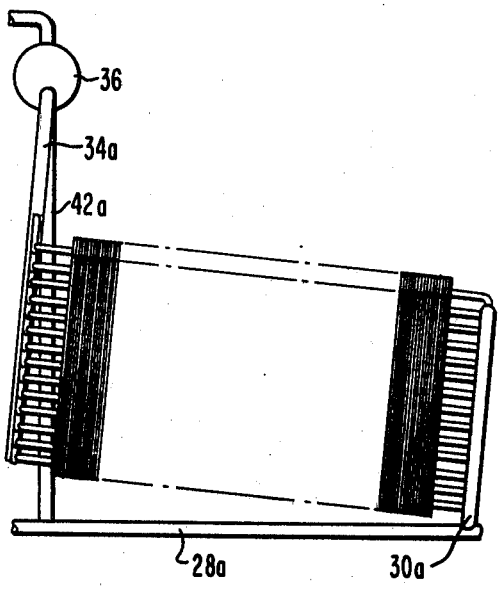
FIG. 3 is a side view of the coil configuration and refrigerant flow arrangement of one coil of FIG. 2A.
Figure 2B:
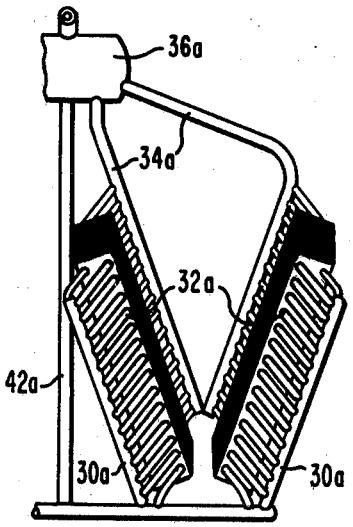
FIG. 2B is an opposite end view of the other half of the coil configuration referred to in FIG. 2A.

FIGS. 2A, 2B and 3 illustrate a heat exchanger design particularly applicable for use in the outdoor unit of an electric heat pump as disclosed in U.S. patent application Ser. No. 461,796, filed Jan. 28, 1983. Reference to that application should be had for details, but for purposes of this application its importance is in the sense of the desirability of providing the outdoor heat exchanger in a W form in which four separate slab coils are oriented to form the W. In FIG. 2A, the coils **32*a* are inclined upwardly toward the viewer with the feed or entry portion 30*a* being at the end of the coil opposite the viewer, and the exit or collector portion 34*a* being at the end toward the viewer. For a heat pump of a nominal capacity of about 4 tons in the particular embodiment shown and designed for a nominal capacity of about $3\frac{1}{2}$ to 4 tons, each coil has 42 parallel tubes in a 3-row deep arrangement. Those parts of the coils and refrigerant flow arrangement which correspond to the parts identified in FIG. 1 are given the same numeral with a suffix a to identify them in FIGS. 2A, 2B and 3**.

Since the plane of the fins 44 are at right angles to the tubes 46 in the inventive arrangement, the fins will be inclined from the vertical to the same degree that the tubes are inclined from the horizontal. It is important that this angle of inclination of the fins not be so high that in a defrost mode the melt from the fins does not drain satisfactorily. The inclination of the fins to the degree noted in connection with the tubes does not significantly affect the defrost drainage.

Figure 4:
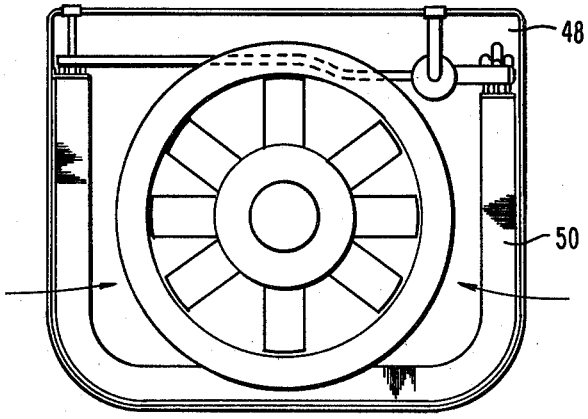
FIG. 4 is a top view of another coil configuration and refrigerant flow arrangement according to the invention for a different type of outdoor unit.
Figure 5:
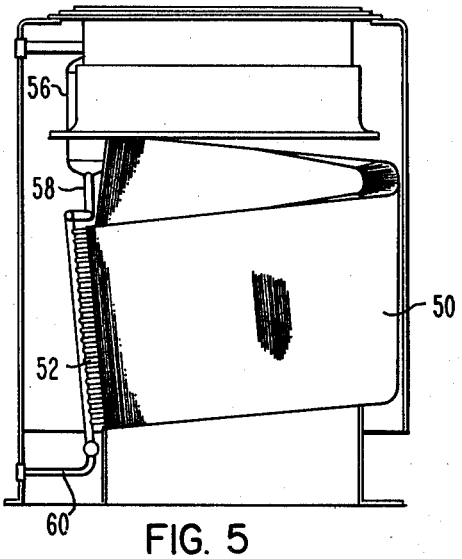
FIG. 5 is a view of one side of the FIG. 4 arrangement.
Figure 6:
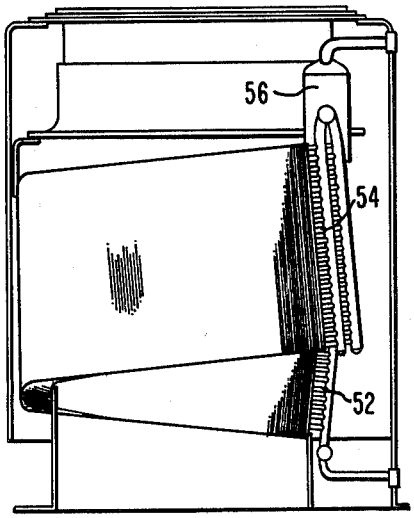
FIG. 6 is a view of the other side of the FIG. 4 arrangement.

In FIGS. 4–6, an outdoor unit 48 is designed to accommodate a coil 50 which, in plan view as in FIG. 4, is of "U" shape. As seen in FIGS. 5 and 6, the entry portion 52 is at a lower level than the exit portion 54 (FIG. 6) with all the tubes of the coil being parallel and of a single pass from entry to exit. The same refrigerant flow arrangement as described in connection with the previous devices is provided including a separator tank 56 from which a downcomer pipe 58 descends to be connected to the feeder pipe 60.

Figure 7:
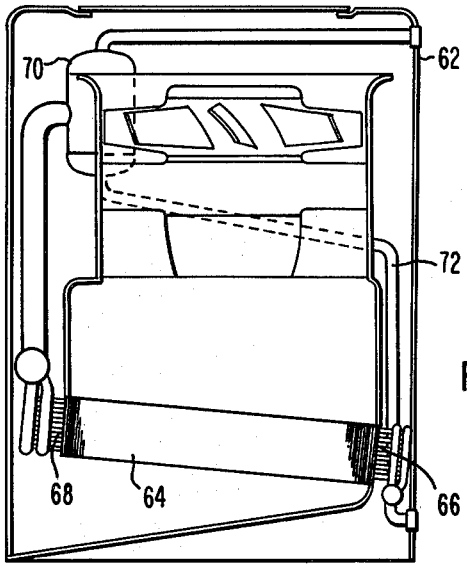
FIG. 7 is an elevation view of another type of outdoor unit to which the invention may be applied.

Another arrangement of the invention in a different outdoor unit 62 is shown in FIG. 7 in which a single-slab coil 64 is provided in the lower part of the unit with the entry end 66 being at a depressed level relative to the exit end 68 and with the same refrigerant flow arrangement including a separator tank 70 and a downcomer 72 leading to the feeder pipe for the entry portion 66 of the coil.

Figure 8:
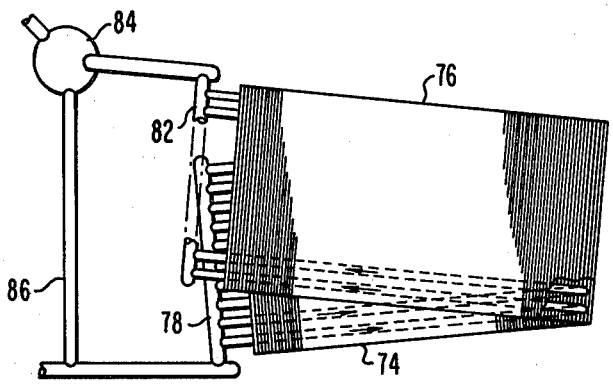
FIG. 8 is a somewhat schematic view in elevation of a way in which a coil can be made and applied in accordance with the invention, but in which both the feed and the collection of refrigerant is at one end of the coil.

In FIG. 8, a coil and flow arrangement is shown in which a single coil is made up of two separate sections which are in laminated relation to each other but in angled relation. In FIG. 8 the coil section 74 farthest from the viewer has an inclination upward to the right while the coil section 76 closest to the viewer has an upward inclination to the left. In the heating mode, the refrigerant flows from the entry header 78 into the section 74 and then passes through U-bend tubes 80 into tubes in the section 76 and to the exit header 82 which is connected to the separator drum 84. A downcomer 86 is also provided. The advantage of this arrangement is, of course, that both the entry and exit headers are both at the same physical end of the coil, although at opposite ends with respect to entry and exit portions. As in the case with the other arrangements, all of the tubes in each individual section are parallel with each other, and the refrigerant flows in a single pass from entry to exit of the coil. A disadvantage of this arrangement is that the coil as a whole has a somewhat larger dimension at the entry-exit end than the coils as shown in FIGS. 2A–3.

All of the coil configurations other than that of FIG. 8 provide for a single pass of refrigerant between the entry and exit ends of the coil relative to the airflow through the coil. In FIG. 8, of course, the arrangement is such that there is a double pass of refrigerant between the ends.

The degree of reduction in pressure drop of the coils according to the invention as shown in FIGS. 2A–3, for example, as compared to a typical optimally designed forced convection coil in which a thermosyphon function is not available, is in the order of 1 to 5. That is, whereas the typical forced convection coil may have a drop of 5 psi, the arrangement according to FIGS. 2A–3 has a drop of about 1 psi. This may be readily translated into a system COP increase of 0.4 when the outdoor temperature is 47° F. (8° C.) and the air delivered to the conditioned structure is 100° F. (38° C.).

The heat transfer performance of the coil operating as an evaporator in the heating mode can be expected to be in the order of approximately 10% higher capacity than that of a properly circuited coil of equal surface area operating in the forced convection mode. However, the heat transfer performance when the coil is operating as a condenser in the cooling mode of the unit can be expected to be slightly below that of such an optimally circuited coil of equal surface area operating in the forced convection mode. However, since the more important mode of operation for a heat pump in the northern climate is when it is operating in the heating mode, the advantage of its better efficiency in the heating mode more than offsets the slight disadvantage of its lesser efficiency in the cooling mode.

I claim:

1. For an air-to-air heat pump having both a heating mode and a cooling mode of operation, an outdoor unit refrigerant coil and refrigerant flow arrangement therefor, comprising:

an extended surface coil of fins on tubes which have a slight upward inclination from one portion serving as the inlet of the coil to another portion serving as the outlet of the coil in the heating mode of said pump;

a refrigerant flow arrangement for said coil operable in a thermosyphon fashion in the heating mode of said pump, said arrangement including means for feeding said one portion refrigerant, means receiving refrigerant passed through said coil from said another portion of said coil, said receiving means being at an elevated height relative to the level of the centroid of said coil, and downcomer means connecting said receiving means to said feeding means to recirculate liquid refrigerant back to said coil in said heating mode of operation of said pump.

2. An arrangement according to claim 1 wherein:

said slight upward inclination is in the range of about 2½° to 10°.

3. An arrangement according to claim 1 wherein:

all of said tubes are in parallel with each other from said one portion to said another portion of said coil.

4. An arrangement according to claim 3 wherein:

all of said tubes provide a single pass of refrigerant relative to the airflow through said coil.

5. For a heat pump having both a heating mode and a cooling mode of operation, an outdoor unit refrigerant coil and refrigerant flow arrangement therefor, comprising:

an extended surface coil of tubes and fins having one end serving as the inlet end in the heating mode and an outlet end in the cooling mode, and an opposite end serving as the inlet end in the cooling mode and as the outlet end in a heating mode, all of the tubes extending in a single pass between said one and opposite ends to provide a single pass for refrigerant between said ends in a direction in accordance with the mode of operation of said pump;

a refrigerant flow arrangement for said coil operable in a thermosyphon fashion in the heating mode of said pump, said arrangement including means feeding refrigerant to said one end of said coil, means receiving refrigerant from the opposite end of said coil, and downcomer means connecting said receiving means to said feeding means for recirculating liquid refrigerant back to said feed means and said coil in the heating mode of operation of said pump; and said coil being inclined slightly upwardly from the one to the opposite end so that said tubes are slightly inclined upwardly from their inlet ends to their outlet ends.

6. An arrangement according to claim 5 wherein:

said upward inclination is in the range of about 2½° to 10°.

* * * * *